US009034121B2

(12) United States Patent
Ohsaki et al.

(10) Patent No.: US 9,034,121 B2
(45) Date of Patent: May 19, 2015

(54) LOW ALLOY STEEL FOR GEOTHERMAL POWER GENERATION TURBINE ROTOR, AND LOW ALLOY MATERIAL FOR GEOTHERMAL POWER GENERATION TURBINE ROTOR AND METHOD FOR MANUFACTURING THE SAME

(75) Inventors: Satoru Ohsaki, Hokkaido (JP); Kazuhiro Miki, Hokkaido (JP); Tsukasa Azuma, Hokkaido (JP); Koji Kajikawa, Hokkaido (JP); Shigeru Suzuki, Hokkaido (JP); Masayuki Yamada, Yokohama (JP); Itaru Murakami, Tokyo (JP); Kenichi Okuno, Yokohama (JP); Liang Yan, Yokohama (JP); Reki Takaku, Yokohama (JP); Akihiro Taniguchi, Yokohama (JP); Tetsuya Yamanaka, Yokohama (JP); Makoto Takahashi, Yokohama (JP); Kenichi Imai, Yokohama (JP); Osamu Watanabe, Yokohama (JP); Joji Kaneko, Tokyo (JP)

(73) Assignees: THE JAPAN STEEL WORKS,LTD., Tokyo (JP); KABUSHIKI KAISHA TOSHIBA, Tokyo (JP)

( * ) Notice: Subject to any disclaimer, the term of this patent is extended or adjusted under 35 U.S.C. 154(b) by 137 days.

(21) Appl. No.: 13/448,770

(22) Filed: Apr. 17, 2012

(65) Prior Publication Data

US 2012/0261038 A1 Oct. 18, 2012

(30) Foreign Application Priority Data

Apr. 18, 2011 (JP) ..... 2011-092340

(51) Int. Cl.

| | |
|---|---|
| ***C22C 38/46*** | (2006.01) |
| ***C21D 6/00*** | (2006.01) |
| ***C22C 38/58*** | (2006.01) |
| ***C22C 38/44*** | (2006.01) |
| ***C21D 7/13*** | (2006.01) |
| ***C21D 1/25*** | (2006.01) |
| ***C21D 1/28*** | (2006.01) |

(52) U.S. Cl.

CPC ..... *C22C 38/58* (2013.01); *C22C 38/44* (2013.01); *C22C 38/46* (2013.01); *C21D 7/13* (2013.01); *C21D 1/25* (2013.01); *C21D 1/28* (2013.01)

(58) Field of Classification Search

USPC ..... 148/335, 559, 663; 420/109

See application file for complete search history.

(56) References Cited

U.S. PATENT DOCUMENTS

| | | | | |
|---|---|---|---|---|
| 4,497,670 | A * | 2/1985 | Siga et al. | 148/506 |
| 6,773,519 | B2 * | 8/2004 | Fujita et al. | 148/335 |
| 2003/0185700 | A1 * | 10/2003 | Ishii et al. | 420/109 |

FOREIGN PATENT DOCUMENTS

| | | | |
|---|---|---|---|
| CN | 1257303 | C | 5/2006 |
| CN | 1844437 | A | 10/2006 |
| EP | 0159119 | A1 | 10/1985 |
| EP | 1123984 | A2 | 8/2001 |
| JP | 52-30716 | A2 | 3/1977 |
| JP | 55-50430 | A | 4/1980 |
| JP | 61-143523 | A | 7/1986 |
| JP | 62-192536 | A | 8/1987 |
| JP | 62-290849 | A | 12/1987 |
| JP | 1-184230 | A | 7/1989 |
| JP | 3-53021 | A | 3/1991 |
| JP | 6-346185 | A | 12/1994 |
| JP | 8-246047 | A | 9/1996 |
| JP | 10-88274 | A | 4/1998 |
| JP | 2001-192730 | A | 7/2001 |
| JP | 2001-221003 | A | 8/2001 |
| JP | 2002-256378 | A | 9/2002 |
| JP | 2002-339036 | A | 11/2002 |
| JP | 2004-2963 | A | 1/2004 |
| JP | 2006-83432 | A | 3/2006 |

OTHER PUBLICATIONS

Machine-English translation of Japanese patent 10-088274, Yano Seinosuke et al., Apr. 7, 1998.*

Office Action dated May 1, 2013 issued by the Japanese Patent Office in counterpart Japanese Patent Application No. 2011-092340.

Communication issued Aug. 30, 2012 by the European Patent Office in counterpart European Application No. 12163260.8.

Kamada et al. "Development of A 12% Cr Steel Rotor Forging For Geothermal Power Plants",. Proceedings 23rd NZ Geothermal Workshop, Jan. 1, 2001, pp. 137-142, XP009161253.

F. Mudry, "Recent trends in steel making and their implications on mechanical properties", Journal de Physique IV, Colloque C7, supplement au Journal de Physique III, Nov. 1993, pp. 51-59, vol. 3.

Communication from the European Patent Office issued Feb. 3, 2014 in a counterpart European Application No. 12163260.8.

Office Action dated Jun. 27, 2014 issued by the State Intellectual Property Office of P.R. China in counterpart Application No. 201210115201.7.

* cited by examiner

*Primary Examiner* — Deborah Yee

(74) *Attorney, Agent, or Firm* — Sughrue Mion, PLLC

(57) ABSTRACT

A low alloy steel ingot contains from 0.15 to 0.30% of C, from 0.03 to 0.2% of Si, from 0.5 to 2.0% of Mn, from 0.1 to 1.3% of Ni, from 1.5 to 3.5% of Cr, from 0.1 to 1.0% of Mo, and more than 0.15 to 0.35% of V, and optionally Ni, with a balance being Fe and unavoidable impurities. Performing quality heat treatment including a quenching step and a tempering step to the low alloy steel ingot to obtain a material, which has a grain size number of from 3 to 7 and is free from pro-eutectoid ferrite in a metallographic structure thereof, and which has a tensile strength of from 760 to 860 MPa and a fracture appearance transition temperature of not higher than 40° C.

8 Claims, No Drawings

LOW ALLOY STEEL FOR GEOTHERMAL POWER GENERATION TURBINE ROTOR, AND LOW ALLOY MATERIAL FOR GEOTHERMAL POWER GENERATION TURBINE ROTOR AND METHOD FOR MANUFACTURING THE SAME

This application claims priority from Japanese Patent Application No. 2011-092340 filed on Apr. 18, 2011, the entire subject-matter of which is incorporated herein by reference.

BACKGROUND OF THE INVENTION

1. Field of the Invention

The present invention relates to a low alloy steel to be used chiefly under a corrosive environment, and in particular, the invention is suitable for application to turbine members such as large-sized turbine rotors for geothermal power generation.

2. Description of the Related Art

In the geothermal power generation, while a steam temperature is low as about 200° C., the steam contains corrosive gases such as hydrogen sulfide. In view of this fact, in turbine rotor materials for geothermal power generation, a high-temperature creep strength which is required for thermal power generation is not necessary, but corrosion resistance, tensile strength at room temperature, yield strength, and toughness are regarded as important. In such a low-temperature range, an NiCrMoV steel with excellent toughness containing from 3 to 4% by mass of Ni is usually used. However, the steel type containing a large amount of Ni involves such a defect that SCC (stress corrosion cracking) is easily caused. Accordingly, materials having enhanced toughness are used for rotors for geothermal power generation on the basis of a 1% CrMoV steel (nominal) which has been developed chiefly as a high pressure rotor or medium pressure rotor for thermal power generation. Since the 1% CrMoV steel for a high pressure rotor or medium pressure rotor for thermal power generation is used in a high-temperature range of 350° C. or higher, while the creep strength is high, large toughness is not necessary. However, in order to use such a 1% CrMoV steel for a geothermal rotor, it is necessary to enhance the toughness. For that reason, the following patents are proposed (see JP-A-52-30716, JP-A-55-50430, JP-A-61-143523 and JP-A-62-290849).

In recent years, following an increase of the power generation capacity, the increasing size of the geothermal power generation turbine rotor is being advanced, and the 1% CrMoV steel, which has been conventionally used, becomes unable to cope with the increasing size of the turbine rotor. This is because the 1% CrMoV steel is a steel type which is difficult to perform the increasing size from the viewpoints of hardenability and segregation resistance. For example, in a case of increasing a size of the 1% CrMoV, there are involved such problems that the cooling rate in a central part of the rotor is largely decreased, and ferrite is precipitated, resulting in a decrease of the toughness; and that the C concentration occurs on the side of a feeder head for steel ingot, resulting in a possibility that quenching crack is caused by water cooling at the time of quenching. In JP-A-52-30716, JP-A-55-50430 and JP-A-61-143523, though the toughness of the 1% CrMoV steel is improved, various problems to be caused due to the increasing size are not taken into consideration, and there is a concern that the toughness is decreased due to a decrease of the cooling rate. In JP-A-62-290849, though a decrease of the cooling rate to be caused due to the increasing size is taken into consideration, the problem regarding the C concentration on the side of a feeder head for steel ingot in the case of manufacturing a large-sized steel ingot is not taken into consideration, and there is a concern that the segregation resistance at the time of manufacturing a large-sized steel ingot is deteriorated.

SUMMARY OF THE INVENTION

Under the foregoing circumstances, an object of the invention is to provide a material suitable for a more large-sized turbine rotor for geothermal power generation, in which the segregation resistance is improved to suppress the C concentration on the side of a feeder head for steel ingot, thereby making it possible to manufacture a homogenous large-sized steel ingot, and furthermore, the hardenability is improved while ensuring toughness, corrosion resistance, and SCC (stress corrosion cracking) resistance, all of which are required for turbine rotors for geothermal power generation; and a method for manufacturing the same.

In order to reduce the segregation, it is necessary that a difference between a density of a composition rich liquid phase of solidification front and a density of a bulk liquid phase in an unsolidified part, which is caused due to solid-liquid distribution at the time of solidification, is small. However, it is difficult to adjust the difference in density only by increasing or decreasing the content of a single element, and a total liquid phase density balance including other composition elements is important. Also, in large-sized turbine rotors for geothermal power generation, in addition to the segregation resistance, mechanical properties, corrosion resistance, and SCC resistance are necessary. The present inventors not only optimized an alloying balance of elements while taking the segregation resistance into consideration but carried out evaluation tests regarding the mechanical properties, corrosion resistance, SCC resistance, and hardenability by using a lot of steel types. As a result, the present inventors have found a composition capable of providing a turbine rotor for geothermal power generation which has corrosion resistance and SCC resistance equal to those of the conventional 1% CrMoV steel and which is excellent in the toughness and manufacturability of a large-sized steel ingot, leading to accomplishment of the invention.

According to a first aspect of the invention, there is provided a low alloy steel for geothermal power generation turbine rotor, comprising: from 0.15 to 0.30% of C; from 0.03 to 0.2% of Si; from 0.5 to 2.0% of Mn; from 0.1 to 1.3% of Ni; from 1.5 to 3.5% of Cr; from 0.1 to 1.0% of Mo; and more than 0.15 to 0.35% of V in terms of % by mass, with a balance being Fe and unavoidable impurities.

According to a second aspect of the invention, the low alloy steel for geothermal power generation turbine rotor further comprises from 0.005 to 0.015% of N in terms of % by mass.

According to a third aspect of the invention, the low alloy steel for geothermal power generation turbine rotor consists of: from 0.15 to 0.30% of C; from 0.03 to 0.2% of Si; from 0.5 to 2.0% of Mn; from 0.1 to 1.3% of Ni; from 1.5 to 3.5% of Cr; from 0.1 to 1.0% of Mo; and more than 0.15 to 0.35% of V in terms of % by mass, with a balance being Fe and unavoidable impurities.

According to a fourth aspect of the invention, the low alloy steel for geothermal power generation turbine rotor consists of: from 0.15 to 0.30% of C; from 0.03 to 0.2% of Si; from 0.5 to 2.0% of Mn; from 0.1 to 1.3% of Ni; from 1.5 to 3.5% of Cr; from 0.1 to 1.0% of Mo; more than 0.15 to 0.35% of V; and from 0.005 to 0.015% of N in terms of % by mass, with a balance being Fe and unavoidable impurities.

According to a fifth aspect of the invention, there is provided a low alloy material for geothermal power generation turbine rotor obtained by quality heat treatment of the low alloy steel according to any one of the first to fourth aspects, wherein the low alloy material has a grain size number of from 3 to 7, and wherein the low alloy material is essentially free from pro-eutectoid ferrite in a metallographic structure thereof.

According to a sixth aspect of the invention, there is provided a low alloy material for geothermal power generation turbine rotor obtained by quality heat treatment of the low alloy steel according to any one of the first to fourth aspects, wherein the low alloy material has a tensile strength of from 760 to 860 MPa, and wherein the low alloy material has a fracture appearance transition temperature of not higher than 40° C.

According to a seventh aspect of the invention, there is provided a method for manufacturing a low alloy material for geothermal power generation turbine rotor, the method comprising: a quenching step comprising: hot forging a steel ingot having the composition according to any one of the first to fourth aspects; heating a material of the hot forged steel ingot at a temperature in the range of from 900 to 950° C.; and performing quenching at a cooling rate of 60° C./hr or more in a central part of the heated material; and a tempering step of, after the quenching step, heating the quenched material at a temperature in the range of from 600 to 700° C.

According to an eighth aspect of the invention, in the method for manufacturing a low alloy material for geothermal power generation turbine rotor, wherein the method is adopted for materials of steel forgings of a power generator member.

According to a ninth aspect of the invention, in the method for manufacturing a low alloy material for geothermal power generation turbine rotor according to the seventh or eighth aspect, wherein the steel ingot is an ingot having a mass of 10 tons or more.

The low alloy steel for geothermal power generation turbine rotor according to the invention contrives to enhance the hardenability and segregation resistance while ensuring the toughness, the corrosion resistance, and the SCC resistance as the turbine rotor for geothermal power generation, and when applied to large-sized steel forgings such as a turbine rotor for geothermal power generation, it is able to contribute to an enhancement of the power generation efficiency.

DETAILED DESCRIPTION

First, the reasons of setting the alloy composition and manufacture condition of the invention will be hereunder described. Incidentally, all of the following contents are % by mass.

<Alloy Composition>

C: From 0.15 to 0.30%

C is an element which is necessary for enhancing the hardenability, forming a carbide together with a carbide forming element such as Cr, Mo, and V, and enhancing the tensile strength and yield strength. In order to obtain the required tensile strength and yield strength, it is necessary to add C in an amount of at least 0.15%. On the other hand, when the amount of C exceeds 0.30%, the toughness, the corrosion resistance, and the SCC resistance are decreased. Accordingly, the content of C is set to the range of from 0.15 to 0.30%. For example, it may be configured to set the lower limit of the content of C to 0.22%, the upper limit thereof to 0.25%, or the content of C to the range of 0.22 to 0.25%.

Incidentally, for the same reasons, it is preferable to set the lower limit of the content of C to 0.20% and the upper limit thereof to 0.27%, respectively.

Si: From 0.03 to 0.2%

Si in the invention is an important element for the purpose of improving the segregation resistance together with Mo as described later. In particular, Si and Mo largely influence the degree of C concentration on the side of a feeder head for large-sized steel ingot, and when Si is added in an amount of 0.03% or more, effects for improving the segregation resistance and suppressing the C concentration on the side of a feeder head for steel ingot are obtained. On the other hand, when the amount of Si exceeds 0.2%, the toughness is decreased, and the required properties are not obtained. Accordingly, the content of Si is set to the range of from 0.03 to 0.2%. For example, it may be configured to set the lower limit of the content of Si to 0.04%, the upper limit thereof to 0.19%, or the content of Si to the range of from 0.04 to 0.19%.

Incidentally, for the same reasons, it is preferable to set the lower limit of the content of Si to 0.05%.

Mn: From 0.5 to 2.0%

Mn is an element which is effective for improving the hardenability and suppressing the precipitation of pro-eutectoid ferrite at the time of quenching. When the alloy contains Mn in an amount of 0.5% or more, the foregoing effects are sufficiently obtained. On the other hand, when the content of Mn exceeds 2.0%, the sensitivity to temper embrittlement is increased, the toughness is decreased, and the SCC resistance is decreased. For that reason, the content of Mn is set to the range of from 0.5 to 2.0%. For example, it may be configured to set the lower limit of the content of Mn to 0.61%, the upper limit thereof to 1.77%, or the content of Mn to the range of 0.61 to 1.77%.

Incidentally, for the same reasons, it is preferable to set the lower limit of the content of Mn to 0.8% and the upper limit thereof to 1.5%, respectively.

Ni: From 0.1 to 1.3%

Similar to Mn, Ni is an element which is also effective for greatly improving the hardenability and suppressing the precipitation of pro-eutectoid ferrite at the time of quenching. When the alloy contains Ni in an amount of 0.1% or more, the foregoing effects are sufficiently obtained. On the other hand, when the content of Ni exceeds 1.3%, the SCC resistance against corrosive gases in a geothermal steam becomes low. For that reason, the content of Ni is set to the range of from 0.1 to 1.3%. For example, it may be configured to set the lower limit of the content of Ni to 0.44%, the upper limit thereof to 0.92%, or the content of Ni to the range of 0.44 to 0.92%.

Incidentally, for the same reasons, it is preferable to set the lower limit of the content of Ni to 0.3% and the upper limit thereof to 1.0%, respectively.

Cr: From 1.5 to 3.5%

Cr is an element which is effective for improving the hardenability and suppressing the precipitation of pro-eutectoid ferrite at the time of quenching. Also, Cr is an element which is effective for forming a fine carbide together with C, thereby enhancing the tensile strength, and which is further effective for enhancing the corrosion resistance to corrosive gases in a geothermal steam and the SCC resistance. When the alloy contains Cr in an amount of 1.5% or more, the foregoing effects are sufficiently obtained. On the other hand, when the content of Cr exceeds 3.5%, not only the toughness is decreased, but galling is easily caused in a bearing part of the turbine rotor. Accordingly, the content of Cr is set to the range of from 1.5 to 3.5%. For example, it may be configured to set the lower limit of the content of Cr to 1.62%, the upper limit thereof to 3.12%, or the content of Cr to the range of 1.62 to 2.48%.

Incidentally, for the same reasons, it is preferable to set the lower limit of the content of Cr to 1.8% and the upper limit thereof to 2.8%, respectively; and it is more preferable to set the lower limit of the content of Cr may be set to 2.0% and the upper limit thereof to 2.5%, respectively.

Mo: From 0.1 to 1.0%

Mo in the invention is one of important elements for the purpose of improving the segregation resistance along with the foregoing Si. In a 1% CrMoV steel which is used for general turbine rotors for geothermal power generation, Mo is added in an amount of from about 1.1 to 1.5%, and from the viewpoint of corrosion resistance, it would be better to increase the amount of Mo. However, from the viewpoint of segregation resistance, it is desirable to suppress the amount of Mo, and when the amount of Mo is set to not more than 1.0%, the effect for suppressing the C concentration on the side of a feeder head for steel ingot is sufficiently obtained. On the other hand, Mo is an element which is effective for improving the hardenability and temper embrittlement and increasing the tensile strength, and in order to obtain that effect, it is necessary that the alloy contains Mo in an amount of at least 0.1%. From the foregoing viewpoints, the content of Mo is set to the range of from 0.1 to 1.0%. For example, it may be configured to set the lower limit of the content of Mo to 0.25%, the upper limit thereof to 0.96%, or the content of Mo to the range of 0.25 to 0.96%.

Incidentally, for the same reasons, it is preferable to set the lower limit of the content of Mo to 0.3% and the upper limit thereof to 0.8%, respectively; and it is more preferable to set the upper limit of the content of Mo to 0.7%.

V: More than 0.15 to 0.35%

V is an element which is effective for forming a fine carbide together with C, thereby enhancing the tensile strength. Also, in the case where an appropriate amount of insoluble vanadium carbide is present in a parent phase, coarsening of grains at the time of quenching and heating can be suppressed, so that an effect for improving the toughness is brought. In order to obtain the foregoing effects, it is necessary that the alloy contains V in an amount of more than 0.15%. On the other hand, when the amount of V exceeds 0.35%, the toughness is decreased. Accordingly, the content of V is set to the range of more than 0.15 to 0.35%. For example, it may be configured to set the lower limit of the content of V to 0.16%, the upper limit thereof to 0.31%, or the content of V to the range of 0.16 to 0.31%.

Incidentally, for the same reasons, it is preferable to set the lower limit of the content of V to 0.18% and the upper limit thereof to 0.30%, respectively; and it is more preferable to set the upper limit of the content of V to 0.24%.

N: From 0.005 to 0.015%

N is an element which is effective for improving the hardenability and suppressing the precipitation of pro-eutectoid ferrite at the time of quenching. Also, since N forms a nitride to contribute to an enhancement of the tensile strength, N is allowed to contain in the alloy, if desired. In order to obtain the foregoing effects, it is necessary that the alloy contains N in an amount of 0.005% or more. On the other hand, when the content of N exceeds 0.015%, the toughness is decreased. Accordingly, the content of N is set to the range of from 0.005 to 0.015%. For example, it may be configured to set the lower limit of the content of N to 0.006%, the upper limit thereof to 0.013%, or the content of N to the range of 0.006 to 0.013%.

Balance: Fe and Unavoidable Impurities

A balance of the alloy contains Fe and unavoidable impurities. Here, the alloy may contain Fe in an amount of from 91.0 to 97.5% by mass. Further, as for the unavoidable impurities, not more than 0.015% of P, not more than 0.015% of S, not more than 0.15% of Cu, not more than 0.015% of Al, not more than 0.02% of As, not more than 0.02% of Sn, not more than 0.02% of Sb and not more than 0.010% of 0 may be contained. For example, 0.005% of P, 0.002% of S, 0.05% of Cu, 0.005% of Al, 0.005% of As, 0.003% of Sn, 0.001% of Sb and 0.0015% of 0 may be contained as the unavoidable impurities.

<Metallographic Structure and Mechanical Properties of Alloy Steel>

Next, the metallographic structure and mechanical properties of the low alloy steel of the invention will be described.

Grain Size Number: From 3 to 7

It is preferable that the steel of the invention has a grain size of from 3 to 7 in terms of a grain size number after quality heat treatment, as measured by the comparison method of JIS-G0551 (Method of Testing Austenite Grain Size for Steel). Further, it is preferable that the steel of the invention is essentially free from pro-eutectoid ferrite in a metallographic structure thereof. Here, the expression "essentially free from pro-eutectoid ferrite" includes a case where the pro-eutectoid ferrite may be contained in the metallographic structure of the steel of the invention with an area ratio of less than 0.01% or less than measurement limit, or a case where no pro-eutectoid is contained in the metallographic structure of the steel of the invention, for example. In view of the fact that the steel of the invention has a grain size number of from 3 to 7 and is essentially free from pro-eutectoid ferrite in a metallographic structure thereof, excellent toughness can be obtained. In the case of coarse grains whose grain size number is smaller than 3, not only the ultrasonic transmissibility is decreased, but the ductility and toughness are decreased, so that the prescribed mechanical properties are not satisfied. On the other hand, when the grain size number is larger than 7, since it is necessary to decrease the quenching temperature, it is difficult on an industrial scale to manufacture a large-sized turbine rotor without precipitation of pro-eutectoid ferrite during cooling at the time of quenching. Also, even in the case where a grain size number after quality heat treatment of from 3 to 7 is obtained, when pro-eutectoid ferrite is precipitated in the metallographic structure, the toughness is largely decreased. Incidentally, for the same reasons, it is more preferable to set the lower limit of the grain size number to 4.0. Tensile strength at room temperature: From 760 to 860 MPa As a target strength, a tensile strength at room temperature after quality heat treatment is set to 760 MPa or more. On the other hand, when the tensile strength at room temperature exceeds 860 MPa, the toughness is decreased, and therefore, the upper limit is set to 860 MPa.

Fracture Appearance Transition Temperature (FATT): Not Higher than 40° C.

In the geothermal power generation, the inlet temperature is 200° C., and the outlet temperature is low as about 50° C., and therefore, it is necessary that the fracture appearance transition temperature (FATT) is thoroughly low. When the FATT is larger than 40° C., it becomes difficult to ensure the safety against the brittle fracture of the turbine rotor. Accordingly, it is preferable that the FATT is not more than 40° C.

<Method for Manufacturing Alloy Material>

Incidentally, the method for manufacturing a low alloy material for geothermal power generation turbine rotor according to the invention is a manufacturing method which is suitable for enhancing the mechanical properties in the low alloy steel of the invention. According to the present manufacturing method, the precipitation of pro-eutectoid ferrite at the time of quenching and cooling is suppressed, thereby enabling one to obtain remarkably favorable mechanical properties. The present manufacturing method of a low alloy steel is hereunder described.

Forging Step:

A steel ingot after solidification is inserted into a heating furnace and heated to a prescribed temperature, followed by performing forging by a large-sized press. According to the forging, voids in the inside of the steel ingot are thermally compression bonded, and a dendritic structure is broken, whereby a grain structure can be obtained. At that time, it is preferable to set the forging temperature to 1,100° C. or higher. When the forging temperature is lower than 1,100° C., the hot workability of a material is decreased, so that there is a risk of the crack initiation during the forging; and the structure becomes a mixed grain size due to a shortage of the forging effect into the inside, thereby causing a decrease of the ultrasonic transmissibility. However, in an ultimate forging step, coarsening of the grains is suppressed, and therefore, it is preferable to decrease the forging temperature as far as possible within the range of 1,100° C. or higher.

Quenching Step:

In general, in the 1% CrMoV steel which is used for the thermal power generation, in order to enhance the high-temperature creep rupture strength, the quenching temperature is set high; a carbide formed in the material is once substantially dissolved in a matrix by means of quenching and heating; and thereafter, the carbide is finely dispersed in the matrix by a tempering treatment. At that time, the quenching temperature is in general in the range of from 950 to 1,000° C. However, in the turbine rotor materials for geothermal power generation, the high-temperature creep rupture strength is not necessary, but the toughness at room temperature is rather important. In order to enhance the toughness, it is effective to make the grains fine in size. In the low alloy steel of the invention, it is preferable to set the quenching temperature to the range of from 900° C. to 950° C. Within this temperature range, insoluble carbides of Cr, Mo and V are allowed to remain, thereby enabling one to suppress coarsening of the grains and to enhance the toughness. When the quenching temperature is higher than this temperature range, though the tensile strength is increased, the grains are coarsened, whereby the ductility and toughness are decreased. On the other hand, when the quenching temperature is lower than this temperature range, since the hardenability is decreased, pro-eutectoid ferrite is precipitated during cooling at the time of quenching, whereby the toughness is decreased. Incidentally, in large-sized steel forgings, since a time required for soaking is different between an external surface area and a central part, the quenching and heating time can be set in conformity with the size of a material.

In cooling at the time of quenching, by increasing the cooling rate, not only the precipitation of pro-eutectoid ferrite can be suppressed, but the toughness can be enhanced. But, in large-sized turbine rotors, since the cooling rate in the central part is largely decreased due to influences of a mass effect, pro-eutectoid ferrite is precipitated, and the toughness is decreased. The low alloy steel of the invention is a composition in which a decrease of the cooling rate in the central part to be caused due to the increasing size is taken into consideration, and so far as the cooling rate at the time of quenching is 60° C./hr or more, pro-eutectoid ferrite is not precipitated, and the toughness is not decreased. On the other hand, when the cooling rate at the time of quenching is lower than 60° C./hr, pro-eutectoid ferrite is precipitated, and the toughness is decreased. Accordingly, it is preferable to set the cooling rate at the time of quenching to 60° C./hr or more. As for the cooling method at that time, any method can be carried out so far as it does not decrease the tensile strength and toughness of a material.

Tempering Step:

In view of the fact that the quenching temperature is set low, since the amount of carbides to be dissolved at the time of quenching and heating is small, the tensile strength after tempering becomes low. For that reason, it is necessary to set the tempering temperature low, thereby obtaining a prescribed tensile strength at room temperature. When the tempering temperature is lower than 600° C., carbides are not sufficiently precipitated, so that the prescribed tensile strength is not obtained. On the other hand, when the tempering temperature is higher than 700° C., carbides are coarsened, so that the prescribed tensile strength is not obtained. Accordingly, it is preferable to set the tempering temperature to the range of from 600 to 700° C. Incidentally, in the tempering step, the heating time can also be properly set in conformity with the size of a material.

EMBODIMENTS

Embodiments of the invention will be hereunder described.

For the purpose of obtaining the foregoing compositions, the low alloy steel ingot of the invention can be made in the usual way, and an ingot-making method thereof is not particularly limited. The obtained low alloy steel is subjected to hot working such as forging. After the hot working, the hot worked material is subjected to normalizing, thereby contriving to homogenize the structure. The normalizing can be, for example, carried out by heating at from 1,000 to 1,100° C., followed by furnace cooling. Furthermore, the quality heat treatment can be carried out by quenching and tempering. The quenching can be, for example, carried out by heating at from 900 to 950° C. and then rapid cooling. After quenching, for example, tempering by heating at from 600 to 700° C. can be carried out. As the tempering temperature, a proper time can be set according to the size and shape of a material.

The low alloy steel of the invention can be set by the foregoing thermal treatment so as to have a tensile strength at room temperature of from 760 to 860 MPa and a grain size of from 3 to 7 in terms of a grain size number in the comparison method of JIS-G0551 (Method of Testing Austenite Grain Size for Steel).

EXAMPLES

A 50-kg test steel ingot having chemical composition of each of Invention Materials Nos. 1 to 15 and Comparative Materials Nos. 16 to 26 as shown in Table 1 was prepared as a test material. Incidentally, Comparative Material No. 22 has chemical composition of a general 1% CrMoV steel for thermal power generation. The 50-kg test steel ingot was made by a vacuum induction melting furnace (VIM) and forged, followed by a prescribed thermal treatment. In order to reproduce the grain size assuming an actual large-sized turbine rotor, the thermal treatment was carried out by first performing a grain-coarsening treatment at 1,200° C. for 2 hours, performing normalizing at 1,100° C. as a preliminary thermal treatment, and then performing tempering at 620° C. Furthermore, the resulting test steel ingot was heated to 920° C. as a quenching and heating temperature and then subjected to a quenching for cooling to room temperature at 60° C./hr assuming a large-sized rotor with a diameter of 1,600 mm. Thereafter, a thermal treatment was carried out so as to have a tensile strength of from 760 to 860 MPa by selecting a tempering temperature in the range of from 600 to 700° C.

and a tempering time in the range of from 10 to 60 hours, thereby obtaining each sample material. The above-obtained sample material was subjected to microstructure observation, tensile test, and Charpy impact test, thereby evaluating the presence or absence of pro-eutectoid ferrite, tensile strength, and fracture appearance transition temperature (FATT).

The results are shown in Table 2. In the Invention Materials, even when the cooling rate at the time of quenching was 60° C./hr, pro-eutectoid ferrite was not precipitated. Also, the tensile strength was sufficiently satisfied with the target range, and it was also confirmed that the FATT was not higher than 40° C. On the other hand, in Comparative Materials Nos. 16, 18, 19, and 21 to 23, pro-eutectoid ferrite was precipitated, and the FATT largely increased as compared with that of the Invention Materials. Also, the tensile strength of these Comparative Materials was lower than that of the Invention Materials and was not satisfied with the target. In Comparative Material No. 26, though pro-eutectoid ferrite was not precipitated, the FATT was higher than that of the Invention Materials. That is, it has become clear that in the Invention Materials, even when the cooling rate at the time of quenching is decreased, not only the precipitation of pro-eutectoid ferrite can be suppressed, but sufficient strength and toughness for large-sized geothermal turbine rotors for geothermal power generation are revealed.

TABLE 1

| Sample material No. | Chemical composition of sample material (% by mass) (Balance: Fe + Unavoidable impurities) C | Si | Mn | Ni | Cr | Mo | V | N |
|---|---|---|---|---|---|---|---|---|
| Invention Material | | | | | | | | |
| 1 | 0.24 | 0.04 | 1.25 | 0.69 | 2.30 | 0.79 | 0.20 | 0.006 |
| 2 | 0.23 | 0.11 | 0.61 | 0.90 | 2.25 | 0.79 | 0.20 | — |
| 3 | 0.24 | 0.15 | 0.86 | 0.75 | 2.26 | 0.80 | 0.20 | 0.009 |
| 4 | 0.24 | 0.19 | 0.84 | 0.92 | 2.24 | 0.79 | 0.21 | — |
| 5 | 0.25 | 0.15 | 1.46 | 0.85 | 2.48 | 0.25 | 0.23 | — |
| 6 | 0.24 | 0.15 | 1.01 | 0.91 | 2.26 | 0.61 | 0.20 | — |
| 7 | 0.24 | 0.14 | 1.00 | 0.91 | 2.26 | 0.80 | 0.21 | — |
| 8 | 0.23 | 0.15 | 0.73 | 0.92 | 2.01 | 0.96 | 0.19 | 0.006 |
| 9 | 0.24 | 0.15 | 1.29 | 0.90 | 2.24 | 0.60 | 0.20 | — |
| 10 | 0.22 | 0.15 | 1.28 | 0.75 | 2.25 | 0.61 | 0.28 | 0.010 |
| 11 | 0.24 | 0.06 | 1.15 | 0.80 | 2.12 | 0.48 | 0.20 | 0.012 |
| 12 | 0.24 | 0.14 | 1.05 | 0.88 | 1.62 | 0.50 | 0.27 | 0.008 |
| 13 | 0.23 | 0.15 | 1.02 | 0.90 | 1.85 | 0.61 | 0.16 | — |
| 14 | 0.23 | 0.15 | 1.00 | 0.80 | 3.12 | 0.64 | 0.22 | 0.013 |
| 15 | 0.24 | 018 | 1.77 | 0.44 | 2.56 | 0.62 | 0.31 | 0.012 |
| Comparative Material | | | | | | | | |
| 16 | 0.25 | 0.23 | 0.81 | 0.90 | 2.16 | 0.79 | 0.13 | — |
| 17 | 0.24 | 0.15 | 1.40 | 0.90 | 2.01 | 0.08 | 0.19 | 0.017 |
| 18 | 0.23 | 0.15 | 0.48 | 0.90 | 2.25 | 0.61 | 0.37 | — |
| 19 | 0.13 | 0.10 | 0.84 | 0.75 | 3.55 | 0.68 | 0.21 | — |
| 20 | 0.23 | 0.14 | 2.03 | 0.70 | 2.24 | 0.60 | 0.14 | 0.006 |
| 21 | 0.24 | 0.15 | 1.72 | 0.08 | 2.15 | 0.85 | 0.23 | 0.004 |
| 22 | 0.30 | 0.07 | 0.77 | 0.35 | 1.15 | 1.30 | 0.21 | — |
| 23 | 0.24 | 0.02 | 0.80 | 0.90 | 2.24 | 0.81 | 0.20 | 0.007 |
| 24 | 0.22 | 0.05 | 1.02 | 0.88 | 2.25 | 1.06 | 0.20 | — |
| 25 | 0.14 | 0.15 | 1.01 | 1.38 | 2.26 | 0.81 | 0.19 | 0.012 |
| 26 | 0.33 | 0.15 | 1.12 | 0.88 | 2.24 | 0.58 | 0.20 | 0.010 |

TABLE 2

| Sample material No. | Quenching evaluation Pro-eutectoid ferrite Absent | Present | Mechanical properties T.S. (MPa) | FATT (° C.) |
|---|---|---|---|---|
| Invention Material | | | | |
| 1 | Yes | — | 837 | 11 |
| 2 | Yes | — | 855 | 19 |

TABLE 2-continued

| Sample material No. | Quenching evaluation Pro-eutectoid ferrite Absent | Present | Mechanical properties T.S. (MPa) | FATT (° C.) |
|---|---|---|---|---|
| 3 | Yes | — | 849 | 16 |
| 4 | Yes | — | 850 | 17 |
| 5 | Yes | — | 770 | −17 |
| 6 | Yes | — | 822 | −2 |
| 7 | Yes | — | 846 | 15 |
| 8 | Yes | — | 851 | 22 |
| 9 | Yes | — | 816 | −5 |
| 10 | Yes | — | 817 | 1 |
| 11 | Yes | — | 813 | 4 |
| 12 | Yes | — | 854 | 24 |
| 13 | Yes | — | 852 | 18 |
| 14 | Yes | — | 763 | −20 |
| 15 | Yes | — | 784 | −15 |
| Comparative Material | | | | |
| 16 | — | Yes | 816 | 60 |
| 17 | Yes | — | 714 | −9 |
| 18 | — | Yes | 858 | 65 |
| 19 | — | Yes | 768 | 52 |
| 20 | Yes | — | 735 | −4 |
| 21 | — | Yes | 805 | 61 |
| 22 | — | Yes | 804 | 64 |
| 23 | — | Yes | 814 | 58 |
| 24 | Yes | — | 840 | 17 |
| 25 | Yes | — | 711 | −15 |
| 26 | Yes | — | 817 | 41 |

Next, each of Invention Materials Nos. 1 to 10 and Comparative materials Nos. 22 to 26 was subjected to the same test using an 8-ton sand mold as that described in a document (*Tetsu-to-Hagané*, No. 54(1995), Vol. 81, "Effect of Alloying Elements on Macrosegregation of Super Clean CrMoV Steel", P. 82), thereby simulating the C concentration of a central part of the large-sized steel ingot. A molten steel having the chemical composition of each of Invention Materials Nos. 1 to 10 and Comparative Materials Nos. 22 to 26 was made in an amount of 8 tons by an electric furnace and a secondary refining furnace, and the molten steel was cast into a sand mold composed of a main body of 840 mm in diameter and 1,015 mm in height and a feeder head of 1,030 mm and 600 mm in height. After solidification of the steel ingot, the steel ingot was cut on the central part in the longitudinal direction, and the distribution of chemical composition in the longitudinal section was examined. A solidification time of the 8-ton sand mold steel ingot is substantially corresponding to a 100-ton die cast material. Table 3 shows a C concentration (% by mass) of the central part directly under a feeder head for the 8-ton steel ingot. In the large-sized steel ingot, since the solidification time is slow, the C concentration of the central part on the side of a feeder head for steel ingot remarkably increases, and when the C concentration is a certain value or more, a quenching crack is easily produced at the time of cooling. It is experientially known that the C concentration at which a quenching crack is produced is 0.38%, and so far as the C concentration is lower than this value, the quenching crack is not produced. The C concentration of the central part of each of the Invention Materials Nos. 1 to 10 was explicitly lower than that of each of the Comparative Materials Nos. 22 to 24 and 26. That is, it has become clear that in the Invention Materials, the increase of the C concentration in the central part of the large-sized steel ingot is suppressed, and a large-sized steel ingot suitable for more large-sized turbine rotors can be manufactured.

TABLE 3

| Sample material No. | C concentration (% by mass) |
|---|---|
| Invention Material | |
| 1 | 0.373 |
| 2 | 0.362 |
| 3 | 0.369 |
| 4 | 0.363 |
| 5 | 0.323 |
| 6 | 0.358 |
| 7 | 0.370 |
| 8 | 0.375 |
| 9 | 0.356 |
| 10 | 0.344 |
| Comparative Material | |
| 22 | 0.398 |
| 23 | 0.393 |
| 24 | 0.409 |
| 25 | 0.363 |
| 26 | 0.387 |

Table 4 shows the results obtained by carrying out a corrosion resistance test and an SCC resistance test of each of the sample materials according to the invention. For the corrosion resistance test, a specimen of 15×25×4 mm was used. The corrosion resistance test was carried out in a hydrogen sulfide saturated aqueous solution having 5% of acetic acid added thereto at 24° C.±1.7° C. as an accelerated environment for 700 hours.

The SCC resistance test was carried out for 700 hours in conformity with the Method B (three-point bending SCC test method) of TM0177 of the international standards NACE (National Association of Corrosion Engineers). An Sc value is an index which expresses the SCC sensitivity while taking specimen dimensions, Young's modulus, load stress, test number, etc. into consideration, and it is meant that the higher the Sc value, the lower the SCC sensitivity, and the higher the SCC resistance.

As shown in Table 4, it is noted that as to a steady corrosion rate, the Invention Materials have favorable corrosion resistance as compared with Comparative Materials Nos. 17, 20, 21, and 26. Also, as to the SCC resistance, the Invention Materials exhibited favorable SCC resistance as compared with Comparative Materials Nos. 16, 17, 20, 21, 25, and 26.

In large-sized turbine rotors for geothermal power generation, it is necessary that all of the mechanical properties, the corrosion resistance, the SCC resistance, the segregation resistance, and the hardenability are satisfied. Though the Comparative Materials were satisfied with a part of the required properties which are needed for forgings for large-sized turbine rotors for geothermal power generation, they were not satisfied with all of the required properties. For example, though Comparative Material No. 24 was satisfied with the tensile strength and was equal to the Invention Materials in terms of the FATT, it was not satisfied with the segregation resistance; and though Comparative Material No. 25 was equal to the Invention Materials in terms of the segregation resistance, it was not satisfied with the target in terms of the tensile strength and was also low in the SCC resistance. On the other hand, the Invention Materials are satisfied with all of the necessary properties, and hence, it is noted that the Invention Materials are suitable for application to large-sized turbine rotors for geothermal power generation to be used under a corrosive environment.

TABLE 4

| Sample material No. | Steady corrosion rate (mm/y) | Stress corrosion cracking resistance (SCC) sensitivity value (Sc value) |
|---|---|---|
| Invention Material | | |
| 1 | 0.01761 | 6.9 |
| 2 | 0.01746 | 7.3 |
| 3 | 0.01735 | 7.4 |
| 4 | 0.01739 | 7.2 |
| 5 | 0.01827 | 6.0 |
| 6 | 0.01743 | 7.3 |
| 7 | 0.01742 | 7.2 |
| 8 | 0.01598 | 7.5 |
| 9 | 0.01914 | 6.7 |
| 10 | 0.01928 | 6.8 |
| 11 | 0.01870 | 6.6 |
| 12 | 0.01832 | 6.3 |
| 13 | 0.01854 | 6.5 |
| 14 | 0.01791 | 7.3 |
| 15 | 0.01965 | 6.6 |
| Comparative Material | | |
| 16 | 0.01869 | 5.9 |
| 17 | 0.02012 | 4.9 |
| 18 | 0.01787 | 6.0 |
| 19 | 0.01860 | 7.3 |
| 20 | 0.02029 | 4.8 |
| 21 | 0.02140 | 5.6 |
| 22 | 0.01763 | 6.4 |
| 23 | 0.01757 | 6.3 |
| 24 | 0.01822 | 6.5 |
| 25 | 0.01891 | 4.6 |
| 26 | 0.03725 | 4.5 |

Next, influences of the grain size on the strength and toughness were examined.

The steel ingots of Sample Materials Nos. 1 to 10 were used as a test material to be submitted in the Example. After forging, each of the steel ingots was subjected to a thermal treatment including normalizing, quenching and tempering, thereby obtaining sample materials having a varied grain size. The grain size number is one as measured by the comparison method of JIS-G0551 (Method of Testing Austenite Grain Size for Steel). Incidentally, in each of the sample materials, the normalizing condition was varied to change the grain size, and thereafter, quenching and tempering were carried out for every sample material under the condition falling within the scope of the invention in such a manner that the tensile strength at room temperature was from 800 to 860 MPa. Each of the obtained sample materials was subjected to microstructure observation and Charpy impact test, thereby evaluating the presence or absence of pro-eutectoid ferrite and fracture appearance transition temperature (FATT).

The results are shown in Table 5. In the sample materials having a grain size number of from 3 to 7, pro-eutectoid ferrite was not precipitated, and the FATT was satisfied with the target. On the other hand, in the sample materials having a grain size number exceeding 7, pro-eutectoid ferrite was precipitated, and the toughness was decreased. Also, in the sample materials having a grain size number of less than 3, the FATT was not satisfied with the target. It is noted from the foregoing that in the Invention Materials, by optimizing the grain size number, the precipitation of pro-eutectoid ferrite at the time of quenching is suppressed, and excellent strength and toughness are obtained.

TABLE 5

| Sample material No. | Grain size number | Presence or absence of pro-eutectoid ferrite: Present | Absent | FATT (° C.) |
|---|---|---|---|---|
| Invention Material | | | | |
| 1 | 3.3 | — | Yes | 33 |
| 2 | 6.5 | — | Yes | −14 |
| 3 | 4.2 | — | Yes | 16 |
| 4 | 3.8 | — | Yes | 27 |
| 5 | 3.2 | — | Yes | 37 |
| 6 | 6.4 | — | Yes | −16 |
| 7 | 4.1 | — | Yes | 18 |
| 8 | 5.7 | — | Yes | −4 |
| 9 | 3.6 | — | Yes | 26 |
| 10 | 6.8 | — | Yes | −18 |
| Comparative Material | | | | |
| 1 | 2.8 | — | Yes | 44 |
| 2 | 7.1 | Yes | — | 58 |
| 3 | 2.8 | — | Yes | 43 |
| 4 | 7.5 | Yes | — | 53 |
| 5 | 2.4 | — | Yes | 56 |
| 6 | 2.6 | — | Yes | 43 |
| 7 | 7.1 | Yes | — | 57 |
| 8 | 2.5 | — | Yes | 48 |
| 9 | 7.3 | Yes | — | 46 |
| 10 | 7.2 | Yes | — | 59 |

Next, influences of the quenching condition and tempering condition on the strength and toughness were examined.

The steel ingot of Sample Material No. 6 was used as a test material to be submitted in the Example. After forging, in order to reproduce the grain size assuming an actual large-sized turbine rotor, a grain-coarsening treatment was carried out at 1,200° C. for 2 hours, followed by normalizing at 1,100° C. as a preliminary thermal treatment and tempering at 620° C. The resulting forged material was subjected to a thermal treatment shown in Table 6 and then to microstructure observation, tensile test, and Charpy impact test, thereby evaluating the presence or absence of pro-eutectoid ferrite, tensile strength and fracture appearance transition temperature (FATT). The results are also shown in Table 6. Incidentally, in Table 6, the cooling rate at the time of quenching is a cooling rate of from the quenching temperature to room temperature.

As shown in Table 6, it is noted that in the sample materials having been subjected to the thermal treatment at a quenching temperature of 920° C. and 940° C., a cooling rate at the time of quenching of 60° C./hr and a tempering temperature of 630° C. and 680° C., pro-eutectoid ferrite was not precipitated, and the tensile strength and FATT are more excellent than those obtained under other thermal treatment conditions. It is noted from the foregoing that in the low alloy steels for geothermal power generation turbine rotor according to the Invention Materials, by optimizing the thermal treatment condition, the precipitation of pro-eutectoid ferrite at the time of quenching is suppressed, and excellent strength and toughness are obtained.

TABLE 6

| | Quenching condition: Quenching temperature and time | Cooling rate at the time of quenching | Tempering condition (Temperature × Time) | Pro-eutectoid ferrite: Absent | Present | Tensile strength (MPa) | FATT (° C.) |
|---|---|---|---|---|---|---|---|
| Invention material (Sample No. 6) | 890° C., 3 hr | 40° C./hr | 580° C., 20 hr | — | Yes | 681 | 70 |
| | | | 630° C., 20 hr | — | Yes | 772 | 60 |
| | | | 680° C., 20 hr | — | Yes | 729 | 48 |
| | | | 730° C., 20 hr | — | Yes | 652 | 46 |
| | | 60° C./hr | 580° C., 20 hr | — | Yes | 702 | 73 |
| | | | 630° C., 20 hr | — | Yes | 796 | 62 |
| | | | 680° C., 20 hr | — | Yes | 752 | 46 |
| | | | 730° C., 20 hr | — | Yes | 672 | 32 |
| | 920° C., 3 hr | 40° C./hr | 580° C., 20 hr | — | Yes | 701 | 72 |
| | | | 630° C., 20 hr | — | Yes | 805 | 62 |
| | | | 680° C., 20 hr | — | Yes | 764 | 51 |
| | | | 730° C., 20 hr | — | Yes | 687 | 47 |
| | | 60° C./hr | 580° C., 20 hr | Yes | — | 723 | 31 |
| | | | 630° C., 20 hr | Yes | — | 830 | −3 |
| | | | 680° C., 20 hr | Yes | — | 788 | −14 |
| | | | 730° C., 20 hr | Yes | — | 708 | −24 |
| | 940° C., 3 hr | 40° C./hr | 580° C., 20 hr | — | Yes | 719 | 49 |
| | | | 630° C., 20 hr | — | Yes | 824 | 64 |
| | | | 680° C., 20 hr | — | Yes | 783 | 57 |
| | | | 730° C., 20 hr | — | Yes | 709 | 50 |
| | | 60° C./hr | 580° C., 20 hr | Yes | — | 741 | 32 |
| | | | 630° C., 20 hr | Yes | — | 849 | 10 |
| | | | 680° C., 20 hr | Yes | — | 807 | −3 |
| | | | 730° C., 20 hr | Yes | — | 731 | −15 |
| | 960° C., 3 hr | 40° C./hr | 580° C., 20 hr | — | Yes | 715 | 58 |
| | | | 630° C., 20 hr | — | Yes | 736 | 101 |
| | | | 680° C., 20 hr | — | Yes | 777 | 64 |
| | | | 730° C., 20 hr | — | Yes | 695 | 60 |
| | | 60° C./hr | 580° C., 20 hr | Yes | — | 747 | 88 |
| | | | 630° C., 20 hr | Yes | — | 882 | 73 |
| | | | 680° C., 20 hr | Yes | — | 822 | 53 |
| | | | 730° C., 20 hr | Yes | — | 737 | 38 |

What is claimed is:

1. A geothermal power generation turbine rotor which is a geothermal power generation turbine rotor forged from a low alloy steel for geothermal power generation turbine rotor, the low alloy steel consisting of:

from 0.15 to 0.30% of C;

from 0.11 to 0.2% of Si;

from 1.05 to 2.0% of Mn;

from 0.1 to 1.3% of Ni;

from 1.5 to 2.56% of Cr;

from 0.1 to 1.0% of Mo; and more than 0.15 to 0.35% of V in terms of % by mass, with a balance being Fe and unavoidable impurities.

2. A geothermal power generation turbine rotor according to claim 1, comprising a low alloy material obtained by quality heat treatment of the low alloy steel, wherein the low alloy material has a grain size number of from 3 to 7, and wherein the low alloy material is essentially free from pro-eutectoid ferrite in a metallographic structure thereof.

3. A geothermal power generation turbine rotor according to claim 1, comprising a low alloy material obtained by quality heat treatment of the low alloy steel, wherein the low alloy material has a tensile strength of from 760 to 860 MPa, and wherein the low alloy material has a fracture appearance transition temperature of not higher than 40° C.

4. A method for manufacturing a geothermal power generation turbine rotor, wherein the geothermal power generation turbine rotor is a geothermal power generation turbine rotor according to claim 1, the method comprising:

a quenching step comprising:

hot forging a steel ingot of the low alloy steel;

heating a material of the hot forged steel ingot at a temperature in the range of from 900 to 950° C.; and performing quenching at a cooling rate of 60° C./hr or more in a central part of the heated material; and a tempering step of, after the quenching step, heating the quenched material at a temperature in the range of from 600 to 700° C.

5. The method for manufacturing a geothermal power generation turbine rotor according to claim 4, wherein the method is adopted for materials of steel forgings of a power generator member.

6. The method for manufacturing a geothermal power generation turbine rotor according to claim 4, wherein the steel ingot is an ingot having a mass of 10 tons or more.

7. The geothermal power generation turbine rotor according to claim 1, wherein Mn is present in a content of from 1.15 to 2.0%.

8. The geothermal power generation turbine rotor according to claim 1, wherein Ni is present in a content of from 0.69 to 1.3%.

* * * * *